US010991321B1

(12) United States Patent
Chen et al.

(10) Patent No.: US 10,991,321 B1
(45) Date of Patent: Apr. 27, 2021

(54) DISPLAY CONTROL METHOD AND DISPLAY APPARATUS

(71) Applicant: Wistron Corporation, New Taipei (TW)

(72) Inventors: Feng-Yuan Chen, New Taipei (TW); Chou-Chieh Chang, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/865,425

(22) Filed: May 4, 2020

(30) Foreign Application Priority Data

Feb. 17, 2020 (TW) ..... 109104918

(51) Int. Cl.
*G09G 3/34* (2006.01)
*G09G 3/36* (2006.01)

(52) U.S. Cl.
CPC ..... *G09G 3/342* (2013.01); *G09G 3/3618* (2013.01); *G09G 2310/0237* (2013.01); *G09G 2320/0626* (2013.01)

(58) Field of Classification Search
CPC ..... G09G 3/342; G09G 3/3618; G09G 2310/0237; G09G 2320/0626
See application file for complete search history.

(56) References Cited

FOREIGN PATENT DOCUMENTS

CN 107111992 B 12/2019
TW 201815160 A 4/2018

*Primary Examiner* — Charles V Hicks
(74) *Attorney, Agent, or Firm* — Winston Hsu

(57) ABSTRACT

A display control method and a display apparatus are provided. The display control method includes receiving a vertical synchronization signal, calculating a refresh rate according to the vertical synchronization signal, comparing the refresh rate with a threshold value to generate a comparison result, and generating a backlight control signal to control of a display panel of the display apparatus according to the comparison result.

16 Claims, 6 Drawing Sheets

DISPLAY CONTROL METHOD AND DISPLAY APPARATUS

BACKGROUND OF THE INVENTION

1. Field of the Invention

The present invention relates to a display control method and a display apparatus, and more particularly, to a display control method and a display control apparatus capable of improving image output quality.

2. Description of the Prior Art

With advancements of display technology, flat panel displays are widely applied in various electronic products, e.g., mobile communication devices, televisions, tablet computers, wearable devices, notebook computers. In general, images can be displayed through the flat panel display while using the electronic product, so that the user can see the images on flat panel display. Since aliasing distortion and motion blur are frequently occurring effects during the operation of the flat panel display, the user may see the object with afterimage, thereby resulting in significant discomfort for the user. A moving picture response time (MPRT) function can be adopted to resolve the abovementioned problem. However, the conventional display device may process image data by using the MPRT method based only upon operating at a fixed refresh rate (RR). Thus, the prior art has to be improved.

SUMMARY OF THE INVENTION

It is therefore an objective of the present invention to provide a display control method and a display apparatus capable of improving image output quality, to solve the above mentioned problems.

According to an aspect of an embodiment, a display control method applied for display apparatus is disclosed. The control method includes receiving a vertical synchronization signal; calculating a refresh rate according to the vertical synchronization signal; comparing the refresh rate with a threshold value to generate a comparison result; and generating a backlight control signal to control light sources of a backlight module of the display apparatus according to the comparison result.

According to an aspect of another embodiment, a display apparatus is disclosed. The display apparatus includes a backlight module; and a display controller, configured to receive a vertical synchronization signal and calculate a refresh rate according to the vertical synchronization signal; wherein the display controller is configured to compare the refresh rate with a threshold value to generate a comparison result and generate a backlight control signal to control light sources of a backlight module of the display apparatus according to the comparison result.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, hardware manufacturers may refer to a component by different names. This document does not intend to distinguish between components that differ in name but not function. In the following description and in the claims, the terms "include" and "comprise" are utilized in an open-ended fashion, and thus should be interpreted to mean "include, but not limited to". Also, the term "couple" is intended to mean either an indirect or direct electrical connection. Accordingly, if one device is coupled to another device, that connection may be through a direct electrical connection, or through an indirect electrical connection via other devices and connections.

Figure 1:
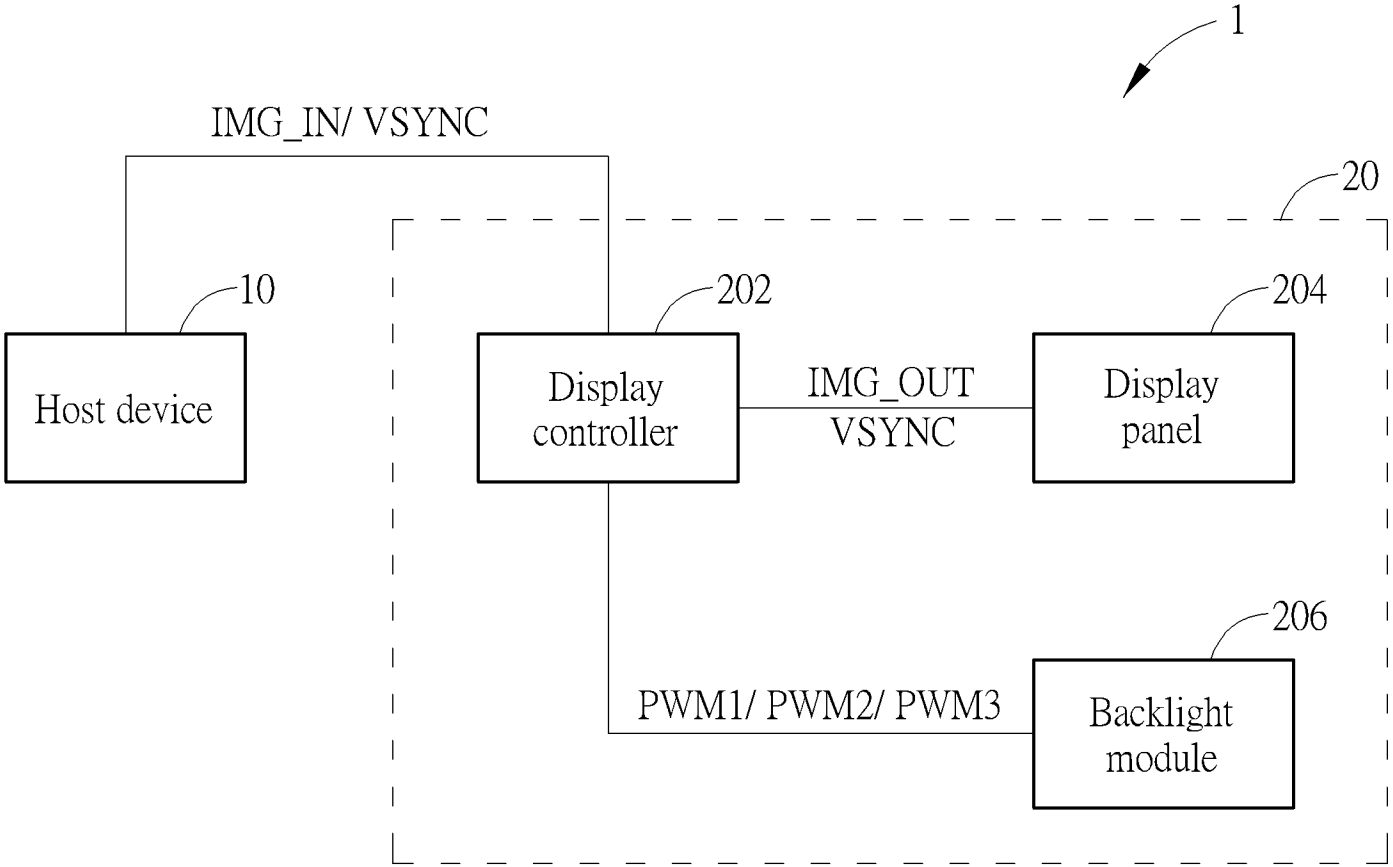
FIG. 1 is a schematic diagram of an electronic system according to an embodiment of the present invention.

Please refer to FIG. 1, which is a schematic diagram of an electronic system 1 according to an embodiment of the present invention. The electronic system 1 includes a host device 10 and a display apparatus 20. The electronic system 1 may be a mobile communication device, a television, a tablet computer, a notebook, a desktop computer, a wearable device or an embedded system product, but not limited thereto. The host device 10 may provide vertical synchronization signals and input image signals. The host device 10 may be a graphic card device with a microprocessor control unit (MCU), a central processing unit (CPU) or a graphics processing unit (GPU), but not limited thereto. The display apparatus 20 includes a display controller 202, a display panel 204 and a backlight module 206. The display controller 202 may be implemented by a scaler, but not limited thereto. The display panel 204 is coupled to the display controller 202. The display panel 204 may be a liquid crystal display panel (LCD), and this should not be a limitation of the invention. The backlight module 206 is coupled to the display controller 202. The backlight module 206 includes at least one light source for emitting light. For example, the at least one light source may be realized with light emitting diodes (LEDs), organic light emitting diodes (OLEDs), micro light emitting diodes (μLEDs) or any other device capable of emitting light. The light emitted by the at least one light source illuminates the display panel 204.

Figure 2:
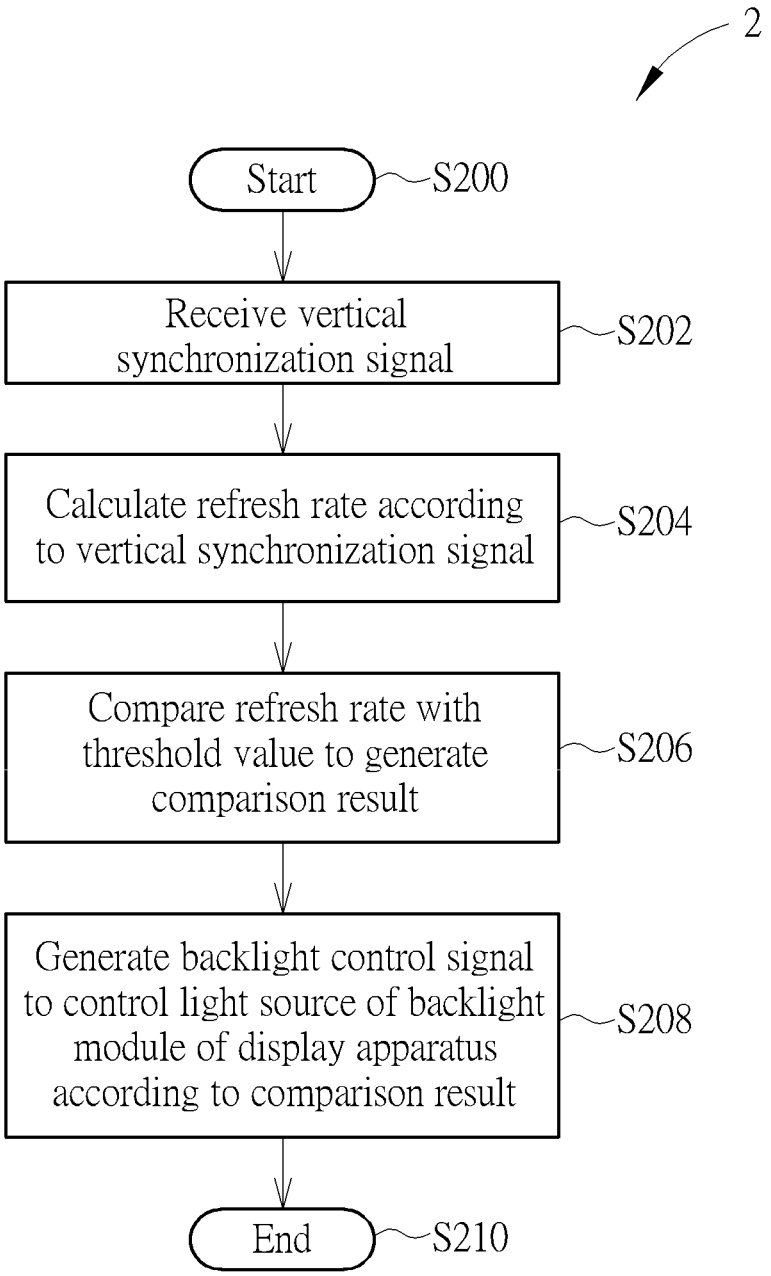
FIG. 2 is a flow diagram of a procedure according to an embodiment of the present invention.

For an illustration of the operations of the electronic system 1, please refer to FIG. 2. FIG. 2 is a flow diagram of a procedure 2 according to an embodiment of the present invention. The flowchart in FIG. 2 mainly corresponds to the operations on the electronic system 1 shown in FIG. 1. The procedure 2 includes the following steps:

Step S200: Start.

Step S202: Receive vertical synchronization signal.

Step S204: Calculate refresh rate according to vertical synchronization signal.

Step S206: Compare refresh rate with threshold value to generate comparison result.

Step S208: Generate backlight control signal to control light source of backlight module of display apparatus according to comparison result.

Step S210: End.

Figure 3A:
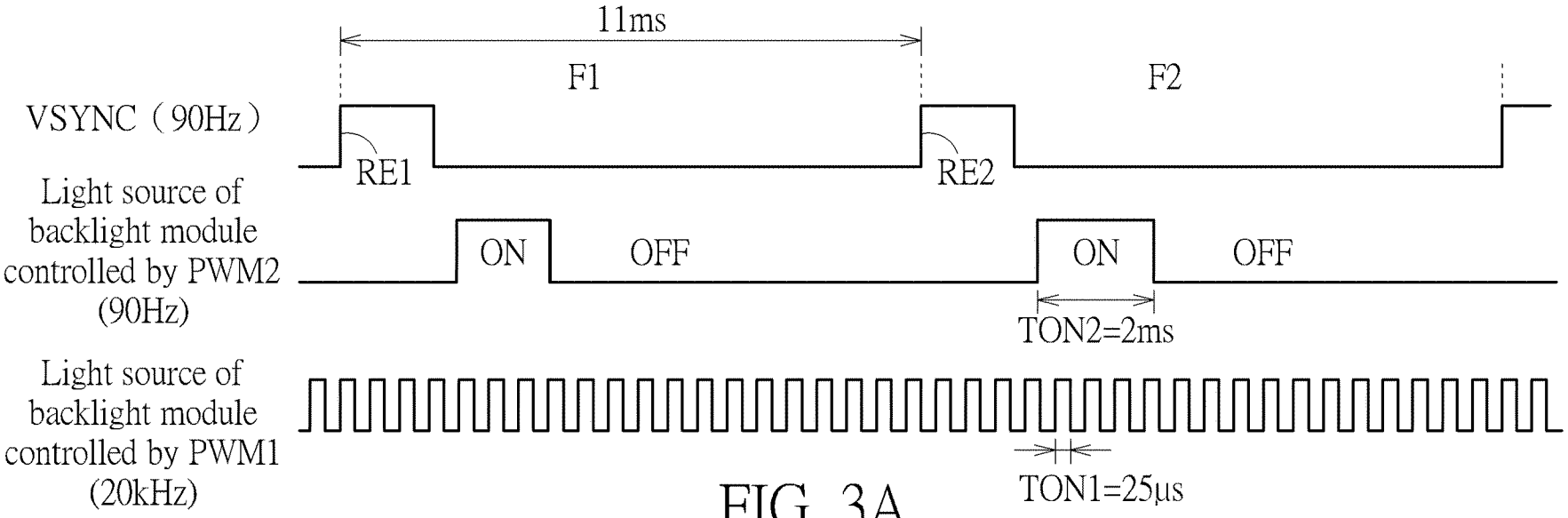
FIG. 3A and FIG. 3B are schematic diagrams illustrating the turn on duration of the light source of the backlight module according to embodiments of the present invention.

According to the procedure 2, in Step S202, the electronic system 1 operates in a variable refresh rate (VRR) mode. The host device 10 is configured to send a vertical synchronization signal VSYNC and an input image signal IMG_IN to the display controller 202. The display controller 202 is configured to receive the vertical synchronization signal VSYNC and the input image signal IMG_IN from the host device 10. The vertical synchronization signal VSYNC indicates the starting and ending points of each frame. For example, as shown in FIG. 3A, a rising edge RE1 represents the beginning of a frame period F1. A rising edge RE2 represents the end of a frame period F1 and the beginning of a frame period F2, and so on. The display controller 202 may perform related image processing operations (e.g., expansion or reduction process of image frame) on the input image signal IMG_IN to generate a display image signal IMG_out provided to the display panel 204.

Figure 3B:
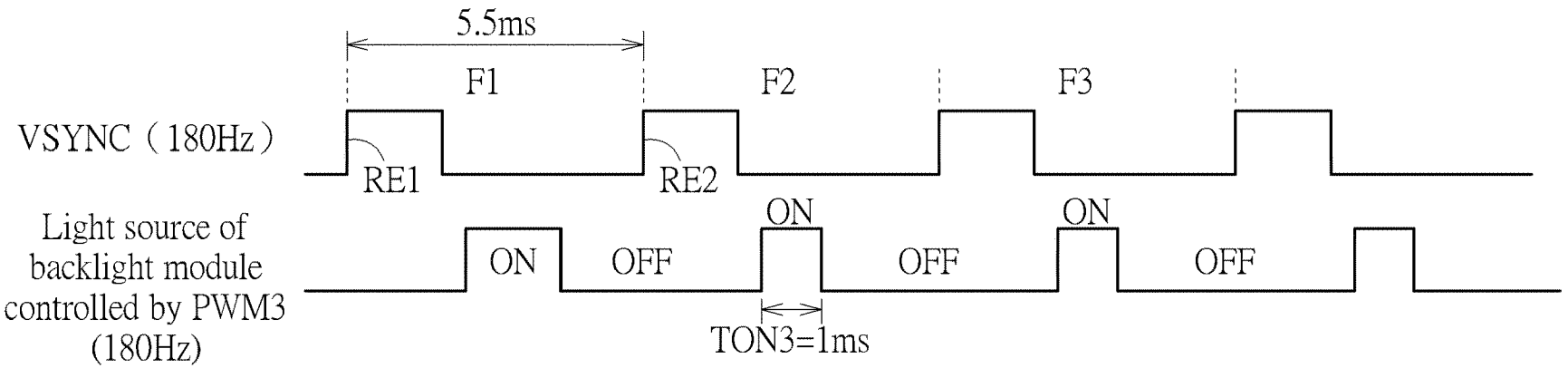

In Step S204, the display controller 202 is configured to calculate a refresh rate according to the vertical synchronization signal VSYNC. The display controller 202 is configured to detect a starting point and an ending point of a first frame period of the vertical synchronization signal VSYNC and calculate an interval length between the starting point and the ending point of the first frame period to obtain a frame length. Further, the display controller 202 is configured to calculate a reciprocal of the frame length to obtain a refresh rate. The reciprocal of the frame length is the refresh rate. The first frame period may be a current frame period. For example, as shown in FIG. 3A, the display controller 202 detects the rising edges RE1 and RE2. The rising edge RE1 represents the starting point of the frame period F1. The rising edge RE2 represents the end of the frame period F1 and the beginning of the frame period F2. The display controller 202 calculates that the interval length between the rising edge RE1 of the vertical synchronization signal VSYNC and the rising edge RE2 of the vertical synchronization signal VSYNC is 11 milliseconds (ms). The display controller 202 calculates that the reciprocal of 11 ms is 90 Hz. That is, the refresh rate is 90 Hz. As shown in FIG. 3B, the display controller 202 detects the rising edges RE1 and RE2. The rising edge RE1 represents the starting point of the frame period F1. The display controller 202 calculates that the interval length between the rising edge RE1 of the vertical synchronization signal VSYNC and the rising edge RE2 of the vertical synchronization signal VSYNC is 5.5 ms. The display controller 202 calculates that the reciprocal of 5.5 ms is 180 Hz. That is, the refresh rate is 180 Hz.

In Step S206, the display controller 202 is configured to compare the refresh rate with a threshold value to generate a comparison result. In Step S208, the display controller 202 is configured to generate a backlight control signal to control light sources of the backlight module 206 according to the comparison result. Therefore, the display panel 204 may display the display image signal IMG_out according to the vertical synchronization signal VSYNC and light sources of the backlight module 206 may turn on or off according to the backlight control signal.

In Step S208, when the comparison result generated in Step S206 indicates that the refresh rate is smaller than the threshold value, the display controller 202 is configured to generate a backlight control signal PWM1 to control the light sources of the backlight module 206. The backlight control signal PWM1 may be a normal backlight dimming control signal. For example, the backlight control signal PWM1 may be a pulse width modulation dimming (PDIM) signal or an amplitude dimming (ADIM) signal. The turn on and turn off operations of the light sources of the backlight module 206 may be controlled according to the backlight control signal in the following frame periods. When the comparison result generated in Step S206 indicates that the refresh rate is greater than or equal to the threshold value, the display controller 202 is configured to adjust the backlight control signal PWM1 to generate an adjusted backlight control signal to control the light sources of the backlight module 206. The turn on and turn off operations of the light sources of the backlight module 206 may be controlled according to the adjusted backlight control signal in the following frame periods. In other words, the embodiment of the present invention generates a normal backlight control signal PWM1 to control the light sources of the backlight module 206 when the currently detected refresh rate is smaller than the threshold value and generates a backlight control signal different from the backlight control signal PWM1 to control the light sources of the backlight module 206 when the currently detected refresh rate is greater than or equal to the threshold value.

In an embodiment, when the comparison result of Step S206 indicates that the refresh rate is greater than or equal to the threshold value, the display controller 202 may adjust the backlight control signal PWM1 to generate a backlight control signal PWM2 to control the light sources of the backlight module 206. A turn on duration (i.e. an duration of on state) of each turning on and off cycle in a second frame period of the light sources of the backlight module 206 controlled by the backlight control signal PWM2 is greater than a turn on duration of each on and off cycle in the second frame period of the light sources of the backlight module 206 controlled by the backlight control signal PWM1. The first frame period may be the current frame period. The second frame period is subsequent to the first frame period. For example, as shown in FIG. 3A, if the threshold value is 85 Hz. When the refresh rate calculated according to the frame period F1 in Step S204 is 75 Hz, the display controller 202 generates the backlight control signal PWM1 to control the light sources of the backlight module 206. When the refresh rate calculated according to the frame period F1 in Step S204 is 90 Hz, the display controller 202 generates the backlight control signal PWM2 to control the light sources of the backlight module 206. In such a condition, as shown in FIG. 3A, a turn on duration TON1 of each turning on and off cycle in the frame period F2 of the light sources of the backlight module 206 controlled by the backlight control signal PWM1 is 25 microseconds (μs). A turn on duration TON2 of each turning on and off cycle in the frame period F2 of the light sources of the backlight module 206 controlled by the backlight control signal PWM2 is 2 ms.

In an embodiment, a switching frequency of on and off operations of the light sources of the backlight may be associated with the pulse frequency of the backlight control signal. A switching frequency of on and off operations in a second frame period of the light sources of the backlight module 206 controlled by the backlight control signal PWM2 is smaller than a switching frequency of on and off operations in the second frame period of the light sources of the backlight module 206 controlled by the backlight control signal PWM1. For example, as shown in FIG. 3A, the switching frequency of on and off operations in the frame period F2 of the light sources of the backlight module 206 controlled by the backlight control signal PWM1 is 20 kHz, i.e. turned on every 25 μs. The switching frequency of on and off operations in the frame period F2 of the light sources of the backlight module 206 controlled by the backlight control signal PWM2 is 90 Hz, i.e. turned on every 11 ms.

Moreover, in Step S208, when the refresh rate is greater than or equal to the threshold value, the display controller 202 may dynamically adjust the backlight control signal PWM1 to generate an adjusted control signal according to the refresh rate, so as to control the light sources of the backlight module 206. For example, when the refresh rate is a first value and the comparison result indicates that the first value is greater than the threshold value, the display controller 202 is configured to dynamically adjust the backlight control signal PWM1 to generate a backlight control signal PWM2 according to the refresh rate, so as to control the light sources of the backlight module 206. The switching frequency of on and off operations in a second frame period of the light sources of the backlight module 206 controlled by the backlight control signal PWM2 may be equal to the first value, or may be varied and designed according to practical system demands. When the refresh rate is a second value and the comparison result indicates that the second value is greater than the threshold value and the first value, the display controller 202 is configured to adjust the backlight control signal PWM1 to generate a backlight control signal PWM3 according to the refresh rate, so as to control the light sources of the backlight module 206. The switching frequency of on and off operations in the second frame period of the light sources of the backlight module 206 controlled by the backlight control signal PWM3 may be equal to the second value, or may be varied and designed according to practical system demands. In an embodiment, a total turn on duration (i.e. a total duration of on state) in the second frame period of the light sources of the backlight module controlled by the backlight control signal PWM2 is greater than a total turn on duration in the second frame period of the light sources of the backlight module controlled by the backlight control signal PWM3. For example, as shown in FIG. 3A, a total turn on duration TON2 in the frame period F2 of the light sources of the backlight module 206 controlled by the backlight control signal PWM2 is 2 ms. As shown in FIG. 3B, a total turn on duration TON3 in the frame period F2 of the light sources of the backlight module 206 controlled by the backlight control signal PWM3 is 1 ms. Under such a situation, TON2>TON3.

Figure 4A:
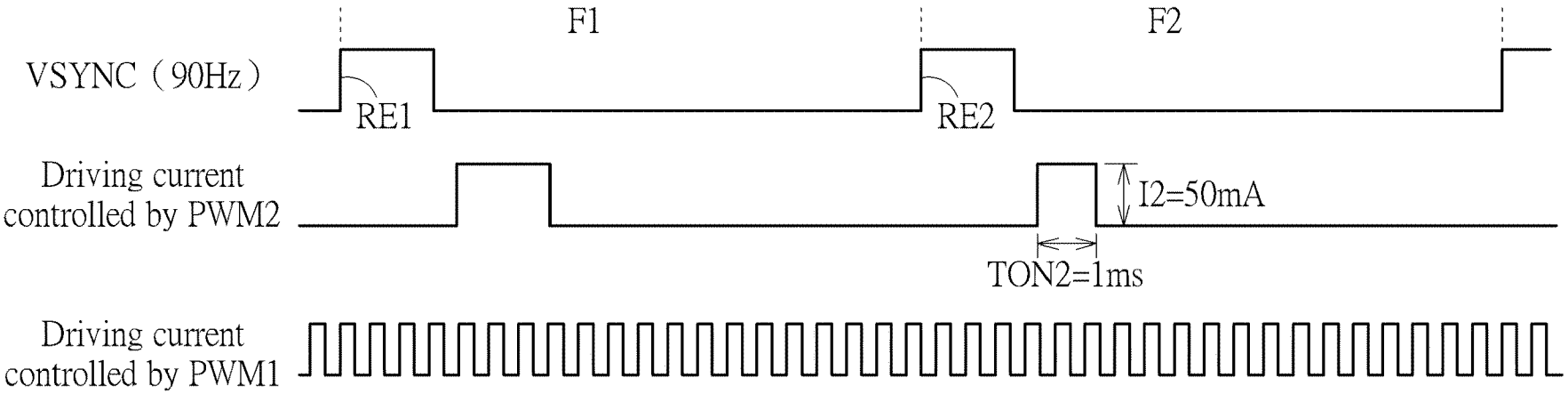
FIG. 4A and FIG. 4B are schematic diagrams illustrating the driving current applied to the light source of the backlight module according to embodiments of the present invention.
Figure 4B:
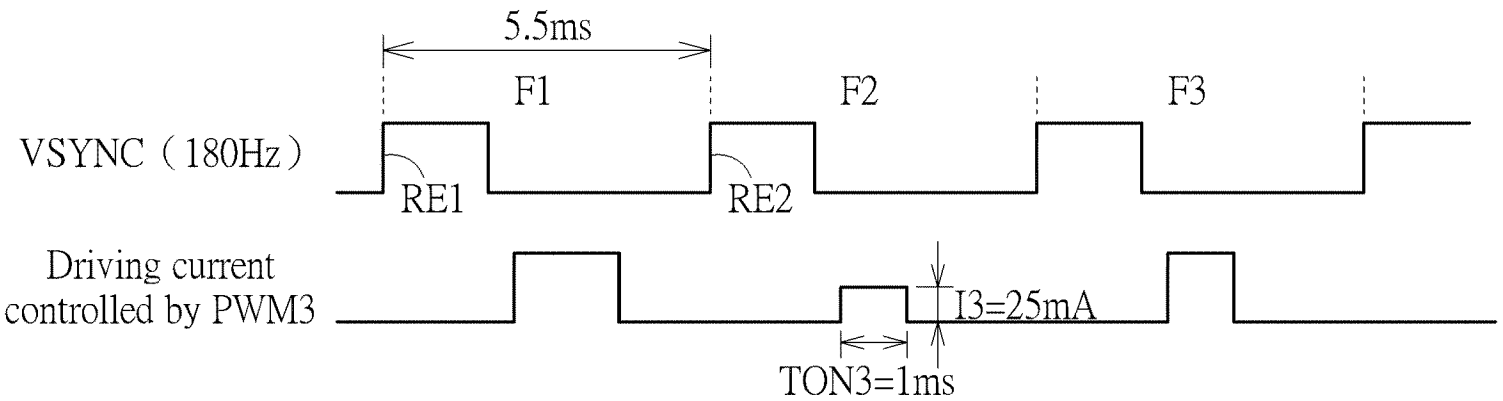

In an embodiment, a total turn on duration in the second frame period of the light sources of the backlight module controlled by the backlight control signal PWM2 is equal to a total turn on duration in the second frame period of the light sources of the backlight module controlled by the backlight control signal PWM3 and a driving current 12 applied to the light sources of the backlight module 206 and controlled by the backlight control signal PWM2 in the second frame period is greater than a driving current 13 applied to the light sources of the backlight module 206 and controlled by the backlight control signal PWM3 in the second frame period. For example, as shown in FIG. 4A, the total turn on duration TON2 in the frame period F2 of the light sources of the backlight module 206 controlled by the backlight control signal PWM2 is 1 ms. A driving current 12 applied to the light sources of the backlight module 206 and controlled by the backlight control signal PWM2 in the second frame period is 50 milliamperes (mA). As shown in FIG. 4B, the total turn on duration TON3 in the frame period F2 of the light sources of the backlight module 206 controlled by the backlight control signal PWM3 is 1 ms. A driving current 13 applied to the light sources of the backlight module 206 and controlled by the backlight control signal PWM3 in the second frame period is 25 mA. Under such a situation, TON2=TON3 and I2>I3.

Figure 5A:
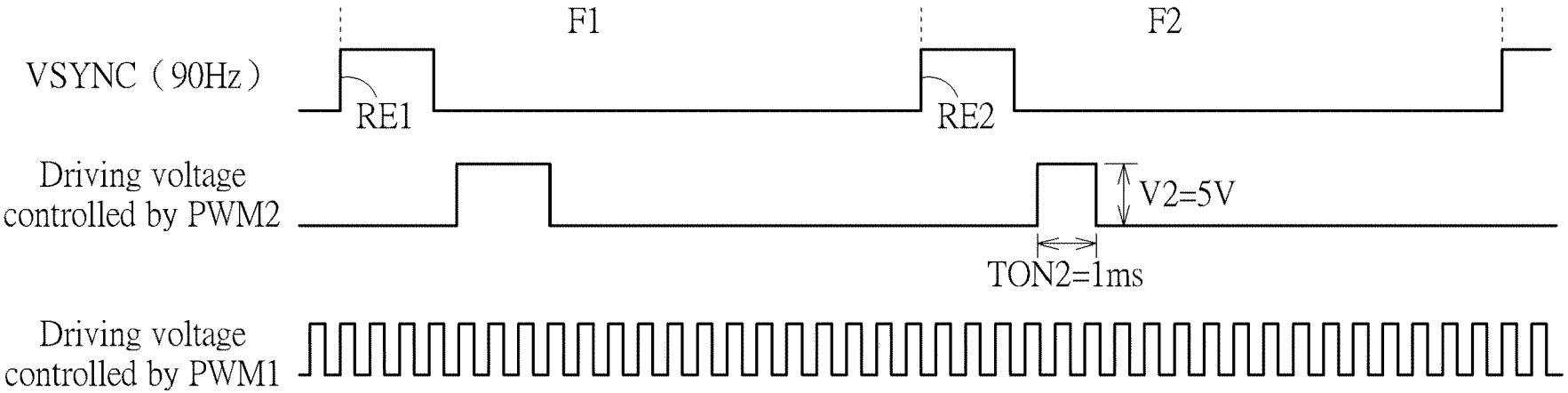
FIG. 5A and FIG. 5B are schematic diagrams illustrating the driving voltage applied to the light source of the backlight module according to embodiments of the present invention.
Figure 5B:
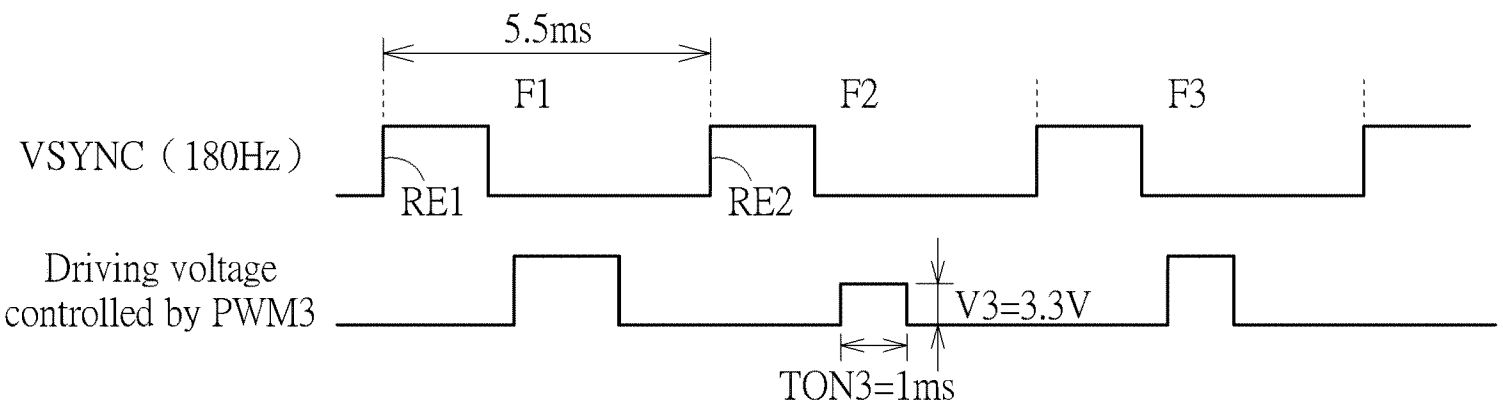

In an embodiment, a total turn on duration in the second frame period of the light sources of the backlight module controlled by the backlight control signal PWM2 is equal to a total turn on duration in the second frame period of the light sources of the backlight module controlled by the backlight control signal PWM3 and a driving voltage V2 applied to the light sources of the backlight module 206 and controlled by the backlight control signal PWM2 in the second frame period is greater than a driving voltage V3 applied to the light sources of the backlight module 206 and controlled by the backlight control signal PWM3 in the second frame period. For example, as shown in FIG. 5A, the total turn on duration TON2 in the frame period F2 of the light sources of the backlight module 206 controlled by the backlight control signal PWM2 is 1 ms. A driving voltage V2 applied to the light sources of the backlight module 206 and controlled by the backlight control signal PWM2 in the second frame period is 5 volts (V). As shown in FIG. 5B, the total turn on duration TON3 in the frame period F2 of the light sources of the backlight module 206 controlled by the backlight control signal PWM3 is 1 ms. A driving voltage V3 applied to the light sources of the backlight module 206 and controlled by the backlight control signal PWM3 in the second frame period is 3.3V. That is, TON2=TON3 and V2>V3.

Figure 6:
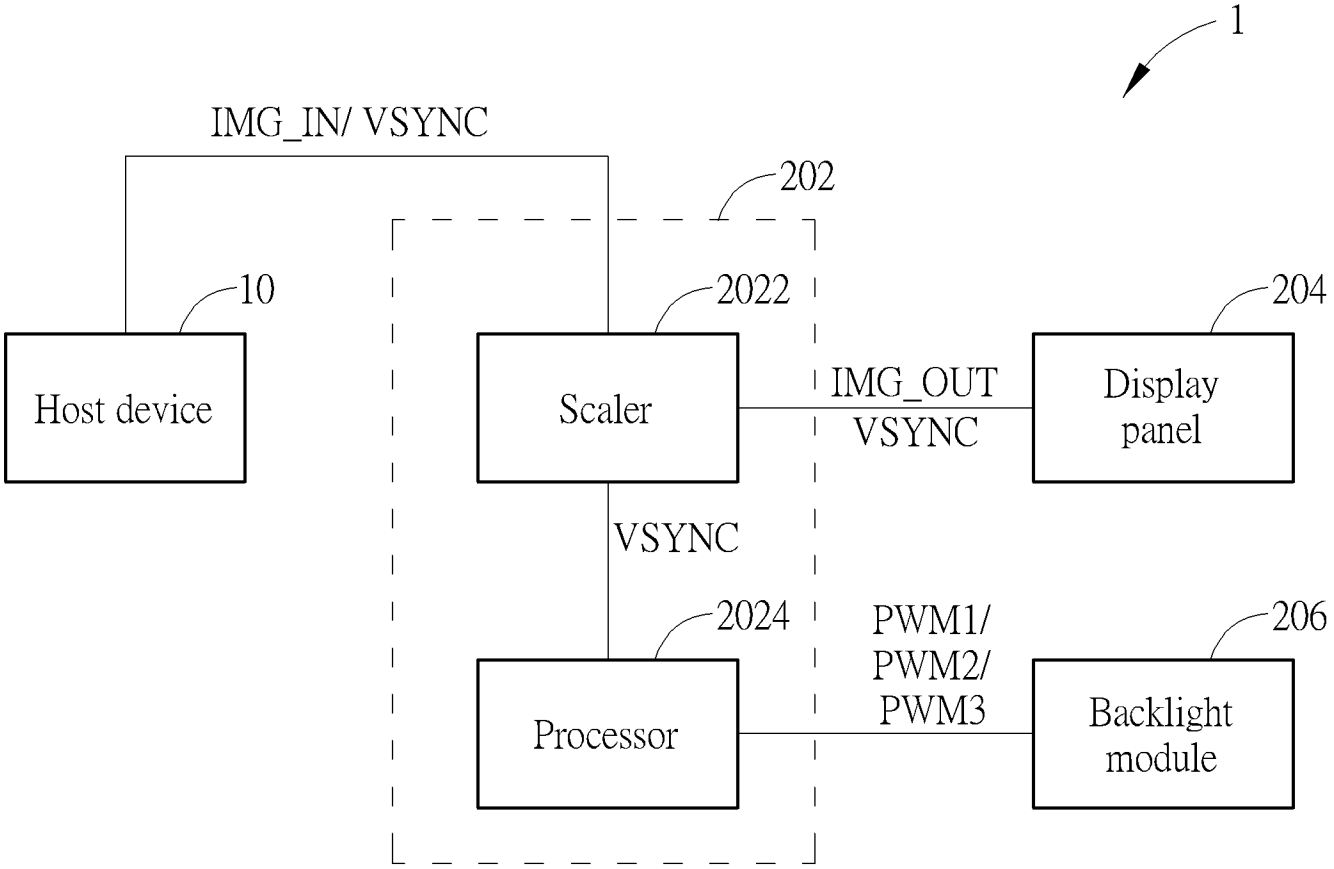
FIG. 6 is a schematic diagram of the display controller shown in FIG. 1 according to an embodiment of the present invention.

Please refer to FIG. 6, which is a schematic diagram of the display controller 202 shown in FIG. 1 according to an embodiment of the present invention. As shown in FIG. 6, the display controller 202 includes a scaler 2022 and a processor 2024. The scaler 2022 may receive the vertical synchronization signal VSYNC and the input image signal IMG_IN from the host device 10. The scaler 2022 may perform related image processing operations (e.g., expansion or reduction process of image frame) on the input image signal IMG_IN to generate a display image signal IMG_OUT, and transmit the vertical synchronization signal VSYNC and the display image signal IMG_OUT to the display panel 204. The display panel 204 displays the display image signal IMG_OUT according to the vertical synchronization signal VSYNC. Moreover, the display panel 204 may transmit the vertical synchronization signal VSYNC to the processor 2024, such that the processor 2024 may execute Steps S204, S206 and S208 according to the vertical synchronization signal VSYNC.

To sum up, the embodiments of the present invention may calculate the refresh rate according to the vertical synchronization signal in the current frame period and generate the backlight control signal to control light sources of the backlight module according to the refresh rate. In other words, the embodiments of the present invention may adjust the operations of the backlight module 206 by utilizing the moving picture response time method when the electronic system operates in the variable refresh rate mode, and thus having the advantages of energy saving, eliminating screen tearing and ghosting, low latency, clear display quality and excellent output quality of moving images.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A display control method for a display apparatus, comprising:

receiving a vertical synchronization signal;

calculating a refresh rate according to the vertical synchronization signal;

comparing the refresh rate with a threshold value to generate a comparison result; and generating a backlight control signal to control light sources of a backlight module of the display apparatus according to the comparison result.

2. The display control method of claim 1, wherein the step of calculating the refresh rate according to the vertical synchronization signal comprises:

detecting a starting point and an ending point of a first frame period of the vertical synchronization signal;

calculating an interval length between the starting point and the ending point of the first frame period to obtain a frame length; and calculating a reciprocal of the frame length to obtain the refresh rate.

3. The display control method of claim 1, wherein the step of generating the backlight control signal to control the light sources of the backlight module of the display apparatus according to the comparison result comprises:

generating a first backlight control signal to control the light sources of the backlight module of the display apparatus when the comparison result indicates that the refresh rate is smaller than the threshold value; and adjusting the first backlight control signal to generate an adjusted backlight control signal to control the light sources of the backlight module according to the refresh rate when the comparison result indicates that the refresh rate is greater than or equal to the threshold value.

4. The display control method of claim 3, wherein the step of adjusting the first backlight control signal to generate the adjusted backlight control signal to control the light sources of the backlight module according to the refresh rate when the comparison result indicates that the refresh rate is greater than or equal to the threshold value comprises:

adjusting the first backlight control signal to generate a second backlight control signal to control the light sources of the backlight module according to the refresh rate when the comparison result indicates that the refresh rate is greater or equal to the threshold value;

wherein a turn on duration of each on and off cycle in a second frame period of the light sources of the backlight module controlled by the second backlight control signal is greater than a turn on duration of each on and off cycle in the second frame period of the light sources of the backlight module controlled by the first backlight control signal.

5. The display control method of claim 3, wherein the step of adjusting the first backlight control signal to generate the adjusted backlight control signal to control the light sources of the backlight module according to the refresh rate when the comparison result indicates that the refresh rate is greater than or equal to the threshold value comprises:

adjusting the first backlight control signal to generate a second backlight control signal to control the light sources of the backlight module according to the refresh rate when the comparison result indicates that the refresh rate is greater than or equal to the threshold value;

wherein a switching frequency of on and off operations in a second frame period of the light sources of the backlight module controlled by the second backlight control signal is smaller than a switching frequency of on and off operations in the second frame period of the light sources of the backlight module controlled by the first backlight control signal.

6. The display control method of claim 3, wherein the step of adjusting the first backlight control signal to generate the adjusted backlight control signal to control the light sources of the backlight module according to the refresh rate when the comparison result indicates that the refresh rate is greater than or equal to the threshold value comprises:

adjusting the first backlight control signal to generate a second backlight control signal to control the light sources of the backlight module according to the refresh rate when the refresh rate is a first value and the comparison result indicates that the first value is greater than the threshold value;

adjusting the first backlight control signal to generate a third backlight control signal to control the light sources of the backlight module according to the refresh rate when the refresh rate is a second value and the comparison result indicates that the second value is greater than the threshold value and the second value is greater than the first value;

wherein a total turn on duration in a second frame period of the light sources of the backlight module controlled by the second backlight control signal is greater than a total turn on duration in the second frame period of the light sources of the backlight module controlled by the third backlight control signal.

7. The display control method of claim 3, wherein the step of adjusting the first backlight control signal to generate the adjusted backlight control signal to control the light sources of the backlight module according to the refresh rate when the comparison result indicates that the refresh rate is greater than or equal to the threshold value comprises:

adjusting the first backlight control signal to generate a second backlight control signal to control the light sources of the backlight module according to the refresh rate when the refresh rate is a first value and the comparison result indicates that the first value is greater than the threshold value;

adjusting the first backlight control signal to generate a third backlight control signal to control the light sources of the backlight module according to the refresh rate when the refresh rate is a second value and the comparison result indicates that the second value is greater than the threshold value and the second value is greater than the first value;

wherein a total turn on duration in a second frame period of the light sources of the backlight module controlled by the second backlight control signal is equal to a total turn on duration in the second frame period of the light sources of the backlight module controlled by the third backlight control signal, and a driving current applied to the light sources of the backlight module and controlled by the second backlight control signal in the second frame period is greater than a driving current applied to the light sources of the backlight module and controlled by the third backlight control signal in the second frame period.

8. The display control method of claim 3, wherein the step of adjusting the first backlight control signal to generate the adjusted backlight control signal to control the light sources of the backlight module according to the refresh rate when the comparison result indicates that the refresh rate is greater than or equal to the threshold value comprises:

adjusting the first backlight control signal to generate a second backlight control signal to control the light sources of the backlight module according to the refresh rate when the refresh rate is a first value and the comparison result indicates that the first value is greater than the threshold value;

adjusting the first backlight control signal to generate a third backlight control signal to control the light sources of the backlight module according to the refresh rate when the refresh rate is a second value and the comparison result indicates that the second value is greater than the threshold value and the second value is greater than the first value;

wherein a total turn on duration in a second frame period of the light sources of the backlight module controlled by the second backlight control signal is equal to a total turn on duration of the on state in the second frame period of the light sources of the backlight module controlled by the third backlight control signal, and a driving voltage applied to the light sources of the backlight module and controlled by the second backlight control signal in the second frame period is greater than a driving voltage applied to the light sources of the backlight module and controlled by the third backlight control signal in the second frame period.

9. A display apparatus, comprising:

a backlight module; and a display controller, configured to receive a vertical synchronization signal and calculate a refresh rate according to the vertical synchronization signal;

wherein the display controller is configured to compare the refresh rate with a threshold value to generate a comparison result and generate a backlight control signal to control light sources of a backlight module of the display apparatus according to the comparison result.

10. The display apparatus of claim 9, wherein the display controller is configured to detect a starting point and an ending point of a first frame period of the vertical synchronization signal, calculate an interval length between the starting point and the ending point of the first frame period to obtain a frame length and calculate a reciprocal of the frame length to obtain the refresh rate.

11. The display apparatus of claim 9, wherein the display controller is configured to generate a first backlight control signal to control the light sources of the backlight module of the display apparatus when the comparison result indicates that the refresh rate is smaller than the threshold value, and the display controller is configured to adjust the first backlight control signal to generate an adjusted backlight control signal to control the light sources of the backlight module according to the refresh rate when the comparison result indicates that the refresh rate is greater than or equal to the threshold value.

12. The display apparatus of claim 11, wherein the display controller is configured to adjust the first backlight control signal to generate a second backlight control signal to control the light sources of the backlight module according to the refresh rate when the comparison result indicates that the refresh rate is greater or equal to the threshold value, wherein a turn on duration of each on and off cycle in a second frame period of the light sources of the backlight module controlled by the second backlight control signal is greater than a turn on duration of each on and off cycle in the second frame period of the light sources of the backlight module controlled by the first backlight control signal.

13. The display apparatus of claim 11, wherein the display controller is configured to adjust the first backlight control signal to generate a second backlight control signal to control the light sources of the backlight module according to the refresh rate when the comparison result indicates that the refresh rate is greater than or equal to the threshold value, wherein a switching frequency of on and off operations in a second frame period of the light sources of the backlight module controlled by the second backlight control signal is smaller than a switching frequency of on and off operations in the second frame period of the light sources of the backlight module controlled by the first backlight control signal.

14. The display apparatus of claim 11, wherein the display controller is configured to adjust the first backlight control signal to generate a second backlight control signal to control the light sources of the backlight module according to the refresh rate when the refresh rate is a first value and the comparison result indicates that the first value is greater than the threshold value, and the display controller is configured to adjust the first backlight control signal to generate a third backlight control signal to control the light sources of the backlight module according to the refresh rate when the refresh rate is a second value and the comparison result indicates that the second value is greater than the threshold value and the second value is greater than the first value, wherein a total turn on duration in a second frame period of the light sources of the backlight module controlled by the second backlight control signal is greater than a total turn on duration in the second frame period of the light sources of the backlight module controlled by the third backlight control signal.

15. The display apparatus of claim 11, wherein the display controller is configured to adjust the first backlight control signal to generate a second backlight control signal to control the light sources of the backlight module according to the refresh rate when the refresh rate is a first value and the comparison result indicates that the first value is greater than the threshold value, and the display controller is configured to adjust the first backlight control signal to generate a third backlight control signal to control the light sources of the backlight module according to the refresh rate when the refresh rate is a second value and the comparison result indicates that the second value is greater than the threshold value and the second value is greater than the first value, wherein a total turn on duration in a second frame period of the light sources of the backlight module controlled by the second backlight control signal is equal to a total turn on duration in the second frame period of the light sources of the backlight module controlled by the third backlight control signal, and a driving current applied to the light sources of the backlight module and controlled by the second backlight control signal in the second frame period is greater than a driving current applied to the light sources of the backlight module and controlled by the third backlight control signal in the second frame period.

16. The display apparatus of claim 11, wherein the display controller is configured to adjust the first backlight control signal to generate a second backlight control signal to control the light sources of the backlight module according to the refresh rate when the refresh rate is a first value and the comparison result indicates that the first value is greater than the threshold value, and the display controller is configured to adjust the first backlight control signal to generate a third backlight control signal to control the light sources of the backlight module according to the refresh rate when the refresh rate is a second value and the comparison result indicates that the second value is greater than the threshold value and the second value is greater than the first value, wherein a total turn on duration in a second frame period of the light sources of the backlight module controlled by the second backlight control signal is equal to a total turn on duration of the on state in the second frame period of the light sources of the backlight module controlled by the third backlight control signal, and a driving voltage applied to the light sources of the backlight module and controlled by the second backlight control signal in the second frame period is greater than a driving voltage applied to the light sources of the backlight module and controlled by the third backlight control signal in the second frame period.

* * * * *